US005239912A

United States Patent [19]

Kauss et al.

[11] Patent Number: 5,239,912

[45] Date of Patent: Aug. 31, 1993

[54] HYDRAULIC CIRCUIT TO LIMIT STATIC AND/OR DYNAMIC PRESSURE LOADS

[75] Inventors: Wolfgang Kauss, Lohr-Wombach; Rainer Biener, Steinfeld Hausen, both of Fed. Rep. of Germany

[73] Assignee: Mannesmann Rexroth GmbH, Lohr/Main, Fed. Rep. of Germany

[21] Appl. No.: 898,207

[22] Filed: Jun. 10, 1992

[30] Foreign Application Priority Data

Jun. 10, 1991 [DE] Fed. Rep. of Germany ..... 4119073

[51] Int. Cl.[5] ..... F15B 11/08; F15B 13/04

[52] U.S. Cl. ..... 91/420; 91/446; 91/448; 91/461

[58] Field of Search ..... 91/444, 426, 446, 448, 91/468, 6, 19, 31, 420, 445, 447, 461, 421

[56] References Cited

U.S. PATENT DOCUMENTS

| | | | |
|---|---|---|---|
| 3,234,857 | 2/1966 | Castelet | 91/461 |
| 4,066,006 | 1/1978 | Heiser | 91/445 X |
| 4,184,334 | 1/1980 | Orth | 91/461 X |
| 4,259,986 | 4/1981 | Maucher et al. | 91/448 X |
| 4,293,040 | 10/1981 | O'Connor | 91/461 X |
| 4,353,286 | 10/1982 | Wetter | 91/445 X |
| 4,622,883 | 11/1986 | Mucheyer | 91/461 X |

FOREIGN PATENT DOCUMENTS

| | | | |
|---|---|---|---|
| 3318052A1 | 7/1984 | Fed. Rep. of Germany . | |
| 3305815A1 | 8/1984 | Fed. Rep. of Germany . | |
| 3440262A1 | 5/1986 | Fed. Rep. of Germany . | |
| 4004931A1 | 8/1991 | Fed. Rep. of Germany . | |
| 0669095 | 7/1979 | U.S.S.R. | 91/426 |

*Primary Examiner*—Edward K. Look
*Assistant Examiner*—Hoang Nguyen
*Attorney, Agent, or Firm*—Stanley P. Fisher

[57] ABSTRACT

A circuit for limiting a static and/or dynamic pressure load in a hydraulically actuated use device which is controlled in a closed control circuit by means of a directional control valve and a mechanically or hydraulically releasable blocking device. Aa pressure control valve is arranged between the use device and the pressure relief valve and being adapted to discharge a hydraulic fluid from the use device to a tank when a predetermined hydraulic pressure in the use device is exceeded. The output port of the pressure relief valve is connected to a hydraulic control line is adapted to hydraulically connect the pressure relief valve to a control side of the control valve. Thus, the control valve is turnable by the discharging pressure of the pressure relief valve in a switching position in which a feed line leading to the use device is connected with the tank, and said blocking device is turned in a released state so that the hydraulic fluid in the use device is dischargeable to the tank via the blocking device and the control valve.

11 Claims, 3 Drawing Sheets

HYDRAULIC CIRCUIT TO LIMIT STATIC AND/OR DYNAMIC PRESSURE LOADS

The invention relates to a circuit to limit a static and/or dynamic pressure load in a use device according to the preamble of claim 1.

It is well known that hydraulic energy can be supplied to a use device such as a lifting piston in a farming machine by means of a continuously active control valve including a blocking device. As a blocking device, normally, a mechanically or hydraulically releasable check valve is used Whose closing member is pilot controlled. Normally, two procedures are used for controlling the slider of the control valve in hydraulic control circuits of this kind:

1. mechanical or electromagnetic direct control,
2. servo-hydraulic or electro-hydraulic pilot control.

In the neutral position of this control valve, the blocking device is closed and, consequently, the volume of oil is restrained between the blocking device and the use device in a leak-free manner. The purpose of this function is that of safety for the lifted apparatus while moving or stationary. Moreover, in the neutral position of the control valve, it is possible to reduce the pump pressure from the load pressure to the stand-by pressure.

In practical use, however, very high pressures may occur in the closed space of the oil volume between the blocking device and the use device:

1. Static loads

For example, if the use device, e.g. a lifting piston, is at the maximum displacement position at the stop of a mechanical limit of lift, the heating of the enclosed oil volume may result in a considerable pressure increase which could lead to a destruction of the tubing or hoses or of the cylinder housing.

2. Dynamic loads

Peak pressures in the enclosed oil volume caused by vibrations during fast movement can surpass, for a short time, the resistance of the above-mentioned components and, likewise, lead to a damaging of same.

Whereas the static or quasi-static pressure increase i.a. resulting from heating can be avoided by a simple, small pressure control valve, for reducing dynamic peak pressures, a relatively large volume flow has to be discharged to the tank within a short period of time. The requirement of absolutely no oil leaks even in an operation after dynamic pressure compensation processes cannot be satisfied by conventional simple pressure control valves. Furthermore, due to the large diameter of the valve required with regard to the large volume flow, the installation of an additional pilot controlled pressure control valve would occupy quite a lot of room in the system.

It is therefore an object of the invention to further develop the generic circuit so that static and dynamic peak pressures can be reduced, while requiring a minimum of devices.

This problem is solved by the characterizing features of claim 1.

By hydraulically connecting the control side of the pressure control valve with the control side of the control valve, upon reaching of the maximum pressure Pz, max in the work line between the blocking device and the use device, a pressure signal is applied to the control side of the control valve, said pressure signal causing an opening of the blocking device and, at the same time, providing a connection between the work line and the tank by way of the valve slider. In this way, already existing hydraulic circuit elements, the blocking device and the valve slider are used to limit the static and/or dynamic peak pressures, so that the constructional space required so far does not have to be increased.

A design of the circuit according to the invention as described in the claims 2 and 3 in combination with claim 10 has the advantage that the positioning control circuit which consists of the controller and a sensor connected thereto, the connection lines to the control valve and the control valve itself remains active, so that position changes of the use device resulting from the dynamic compensation processes can be compensated.

A circuit of a particularly simple construction is possible by the further developments according to the claims 7 and 8. As to this circuit which further develops the circuit according to claim 1 in a particularly advantageous way, as a result of the biasing of the valve slider into a switch position B in which the work line is connected to the tank, an actuation of the control valve during the compensation processes for limiting dynamic pressure loads is not necessary, so that the entire hydraulic circuit can be simplified and, additionally, the time of response to a pressure signal generated at the pressure control valve can be reduced.

In the following, the invention will be explained in detail by considering preferred embodiments and referring to the drawings.

Figure 1:
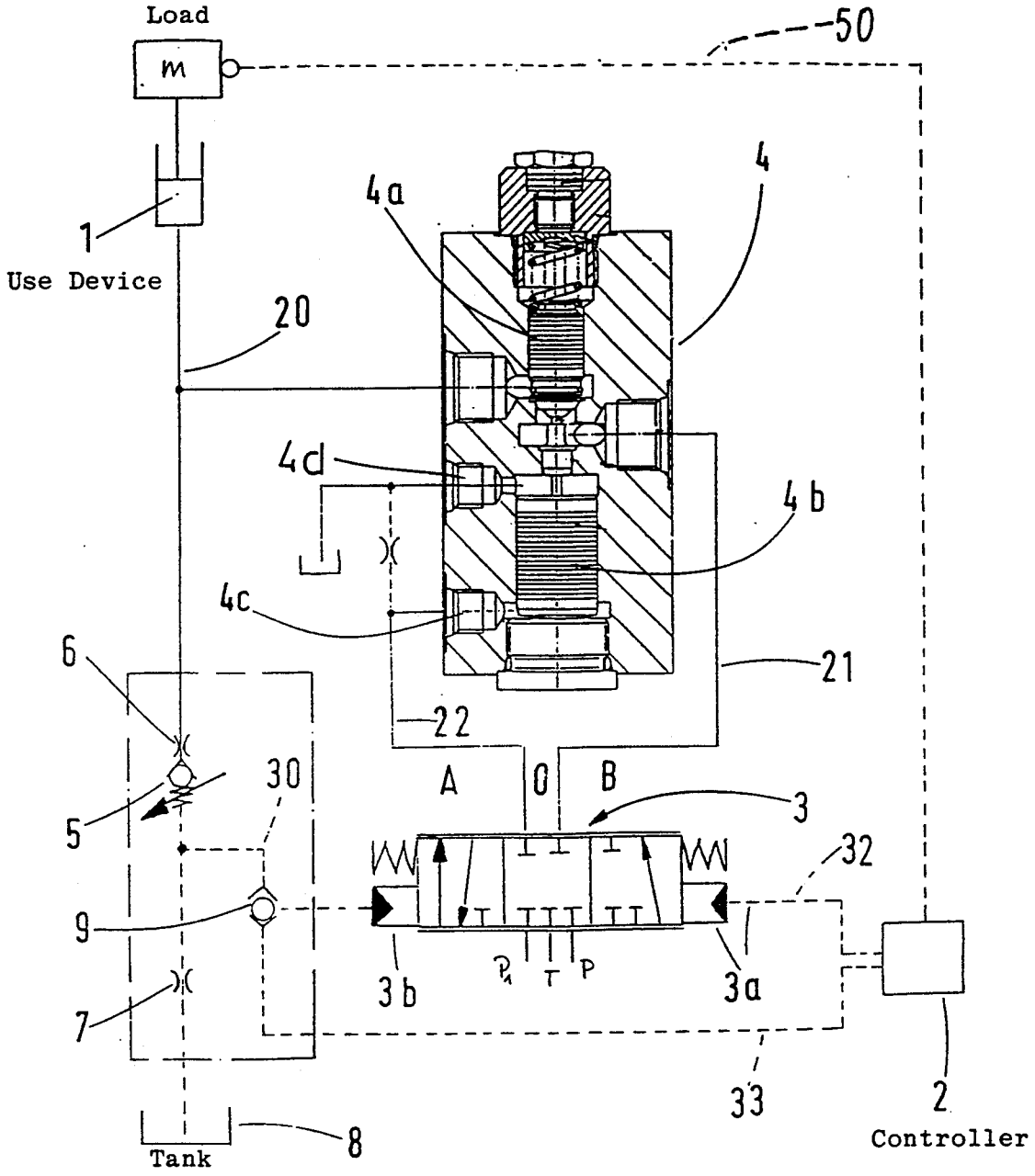
FIG. 1 shows a control circuit as claimed according to a first embodiment.

According to FIG. 1, hydraulic fluid is supplied to a use device 1 in the form of a power lift by way of a blocking device 4, a hydraulically controlled proportional control valve 3 and by means of a feed pump (not shown) connected to a pump port P of the control valve 3.

In the first embodiment, the control valve is designed as a 5/3 proportional valve. The three switching positions are indicated as A, B and 0, where the piston slider can be adjusted to its central position by two springs and can be displaced to any of the other positions A and B by a suitable control of the control valve's control sides 3*a*, 3*b* by means of a controller 2. The control valve 3 has the pump port P, a tank port T and a control port $P_1$, a port for a control line 22 as well as a working port to a Work line 21. In the neutral position 0 shown in FIG. 1 which is maintained by the springs when no or identical signals are applied to the control sides 3*a*, 3*b* by the pilot control circuit, all ports of the control valve 3 are closed. In the position B, the work line 21 leading to the use device 1 is connected to the feed pump by way of the pump port P. In the position A, the Working pressure line 21 is connected to the tank port T, while the control port $P_1$ is connected to the control line 22.

Between the control valve 3 and the use device 1, there is a blocking device 4 which is designed as a releasable pilot controlled check valve including an additional oil leakage port 4*d*. Such a blocking device is known, for example, from the publication "Der Hydrauliktrainer", vol. 1, Mannesmann Rexroth, 1980, so that for any details regarding its construction this publication is referred to.

The blocking device 4 has a main cone 4a which is biased to a seat by a spring. In its housing, two pressure ports which are connected to the work line 20 and 21 are provided. If pressure is applied to the work line 21, the main cone 4a raises against the biasing force of the spring, whereby the hydraulic fluid is discharged towards the use device 1 via the work line 20. If the hydraulic pressure in the work line 21 falls to a predetermined value, the main cone 4a is pressed onto its seat by the biasing spring, so that the hydraulic pressure in the work line 20 is maintained at its last value and the volume of the hydraulic fluid is restrained between the use device 1 and the blocking device 4. Additionally, the housing of the blocking device 4 includes a control port 4c via which a hydraulic control pressure can be applied to a control piston 4b through the control line 22. The control piston 4b is lifted when a predetermined control pressure is applied to the control port 4c, thereby, the main cone 4a being removed from its this switching position, the hydraulic pressure can be discharged from the use device 1 to the work line 21 by way of the work line 20 and the blocking device 4.

In a branch of the work line 20, a variably biased pressure control valve 5 with an orifice plate 6 arranged therebefore is provided, a spring being provided on the control side of said pressure control valve. On the one hand, via a return line and an orifice plate 7 arranged thereafter, the control side of the pressure control valve 5 is connected to a tank 8; on the other hand, via a control line 30, it is connected to a shuttle valve 9 whose other input port is connected to the controller 2 via a connection line 33 of the pilot control circuit. The output port of the shuttle valve 9 is directed towards the control side 3b of the control valve 3, so that the highest pressure of each the control line 30 branching off from the pressure control valve 5 and of the connection line 33 is applied to the control side 3b. The shuttle valve 9 which is arranged between the control line 30 and the connection line 33 and by which, when the pressure signal generated at the pressure control valve 5 is applied to it, a connection between the control line 30 and the pilot control circuit of the control valve 3 can be produced decouples the control circuit for pressure control in the use device and the pilot control circuit of the control valve 3 or, to be more precise, the pressures in the connection line 33 and the control line 30. Both orifice plates 6 and 7 are designed so that the pressure level in the control line 30 is approximately adjusted to that of the pilot control circuit of the control valve 3.

Besides, the controller 2 is connected to the other control side 3a of the control valve 3 via a second connection line 32 of the pilot control circuit. The use device 1 is provided with a sensor which detects the instantaneous position of the use device 1 and transmits suitable signals to the controller 2 through the line 50.

The sensor, the line 50, the controller and the connection lines 32, 33 constitute a positioning control circuit of the use device 1.

In the following, the function of the circuit according to the invention is explained in detail by considering the first embodiment:

For example, in order to actuate the use device 1 to lift a load m, the control valve 3 is controlled on its control side 3a, whereby the valve slider is displaced from its neutral position 0 according to FIG. 1 to the left (position B). Thereby, the pump pressure P is applied to the work line 21, thereby, the main cone of the blocking device 4 being lifted from its seat, so that hydraulic fluid flows into the cylinder of the use device 1 through the work line 20.

If, for example, the control valve 3 is anew brought into an inoperative state, that is into its neutral position, e.g. after the use device has been extended to its maximum lifting position, the main cone of the blocking device 4 is Pressed onto its seat by the pressure in the use device 1; this means that the blocking device 4 blocks a reflux of the hydraulic fluid towards the control valve 3, so that the oil volume is restrained between the use device 1 and the blocking device 4.

If pressure, in a stationary state, slowly begins to increase (static pressure increase) as a result of a temperature increase, the power supply being switched off, the pressure control valve 5 opens after a maximum pressure value Pz, max has been exceeded, whereby the overpressure existing in the use device 1 and the work line 20 is discharged to the tank 8. As a result of the power supply being switched off, the control valve 3 and the stop valve 4 in this case remain in their locking positions (FIG. 1).

If now, during movement, that is when the power supply is switched on, there are dynamic pressure increases caused by vibrations whose peak pressures for a short time exceed the maximum pressure Pz, max, the pressure control valve 5 opens within an accordingly short time, whereby a pressure signal is supplied to the hydraulic pilot control circuit of the inoperative control valve 3 via the control line 30, said pressure signal displacing the valve slider of the control valve 3 according to FIG. 1 to the right (position A). Now, a control pressure $P_1$ is supplied from the control line which is not shown to the control line 22, said control pressure $P_1$ causing a lifting of the control piston 4b and, therefore, of the main cone 4a, so that the blocking device 4 is released and the work line 20 is directly connected to the tank 8 by way of the blocking device 4 and the valve slider of the control valve and, within a very short time, a large volume of hydraulic fluid can be discharged to the tank 8. If, at this point, the pressure falls below the predetermined maximum pressure $Pz_{max}$, the pressure control valve 5 is closed, so that no longer a control pressure is applied to the control side 3i via the control line 30. Due to the spring tension, the slider of the control valve 3 is moved back into its neutral position in which the connection between the work line 21 and the tank 8 is interrupted again. Thereby, the pressure level of the pressure signal is adjusted to the level of the pilot control circuit by the orifice plates 6 and 7.

As the positioning control circuit remains active during the whole phase of the operation, position changes resulting from the dynamic compensation processes for limiting the peak pressures of the use device are compensated by the characteristic and dynamics of the control.

Figure 2:
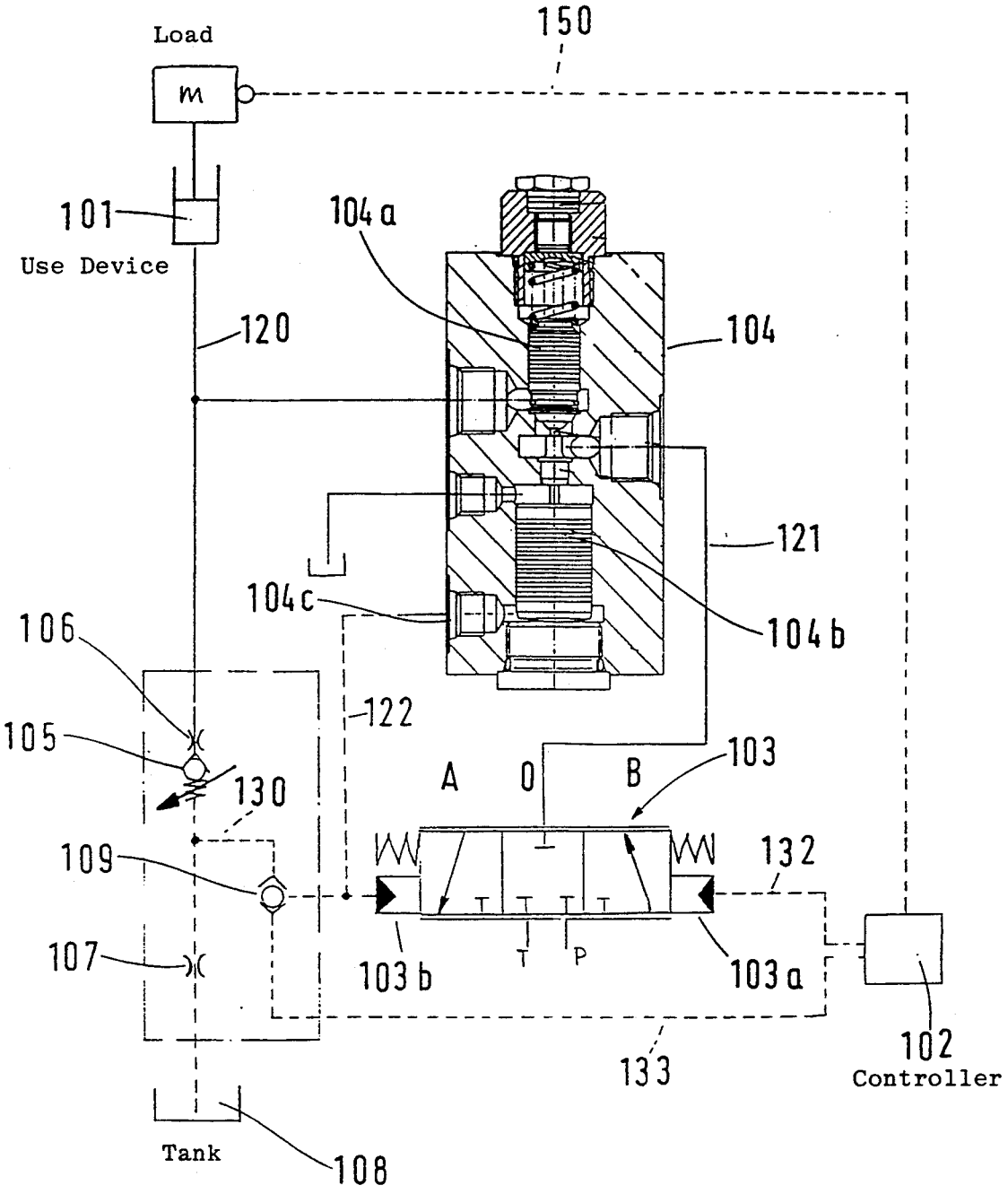
FIG. 2 shows the control of a control valve and a blocking device according to a second embodiment.

The second embodiment according to FIG. 2 comprises a hydraulically pilot controlled 3/3 control valve 103 for controlling the use device 101, which, in accordance with the control valve 3 of the first embodiment, is connected to a controller 102 on both control sides 103a and 103b by way of the connection lines 132, 133 and controls the connection between the work line 121 and the feed pump and/or the tank 108. In contrast to the circuit of the first embodiment, according to the second embodiment, no separate control line 22 is provided from the control valve 3 to the blocking device 4, but a control line 122 is directly connected to the connection line 133 which is connected to the control port 104c of the blocking device 104. Thereby, the pilot control signal of the pressure control valve 5 is branched off via the control line 122 downstream of the shuttle valve 109 and led directly to the control port 104c of the blocking device 4. The remainder of the circuit essentially corresponds to the above-described circuit according to the first embodiment, so that one can refer to the preceding descriptions for the fundamentals of the circuit construction.

When compensating static pressure loads, the power supply being switched off, the hydraulic fluid in the work line 120 leading to the use device 101 is discharged to the tank 108 via the pressure control valve 105 like in the above-described embodiment.

If the peak pressures of dynamic pressure increases in the use device 101 exceed the predetermined maximum pressure $Pz_{max}$, the directly controlled pressure control valve 105 opens, whereby a pressure signal is directed, through the shuttle valve 109, into the hydraulic pilot control circuit at the control side 103b of the control valve 103. Thereby, simultaneously, the same pressure signal is applied to the control port 104c of the blocking device 104 via the control line 122. By the movement of the control piston 104b resulting therefrom, the main cone 104a in the blocking device 104 is lifted, so that the use device 101 is connected to the work line 121 via the blocking device 104. Simultaneously, the slider of the control valve 103 according to FIG. 2 is displaced to the right (position A), so that hydraulic fluid is discharged from the use device 101 to the tank 108 via the blocking device 104.

After the pressure in the use device has fallen below the maximum pressure $Pz_{max}$, the pressure control valve 105 and, simultaneously, the main cone 104a of the blocking device 104 are closed, while the slider of the control valve 103 is displaced to the neutral position 0 by the biasing force of the springs arranged on the control side, thereby, the connection between the work line 121 and the tank 108 being interrupted again.

Figure 3:
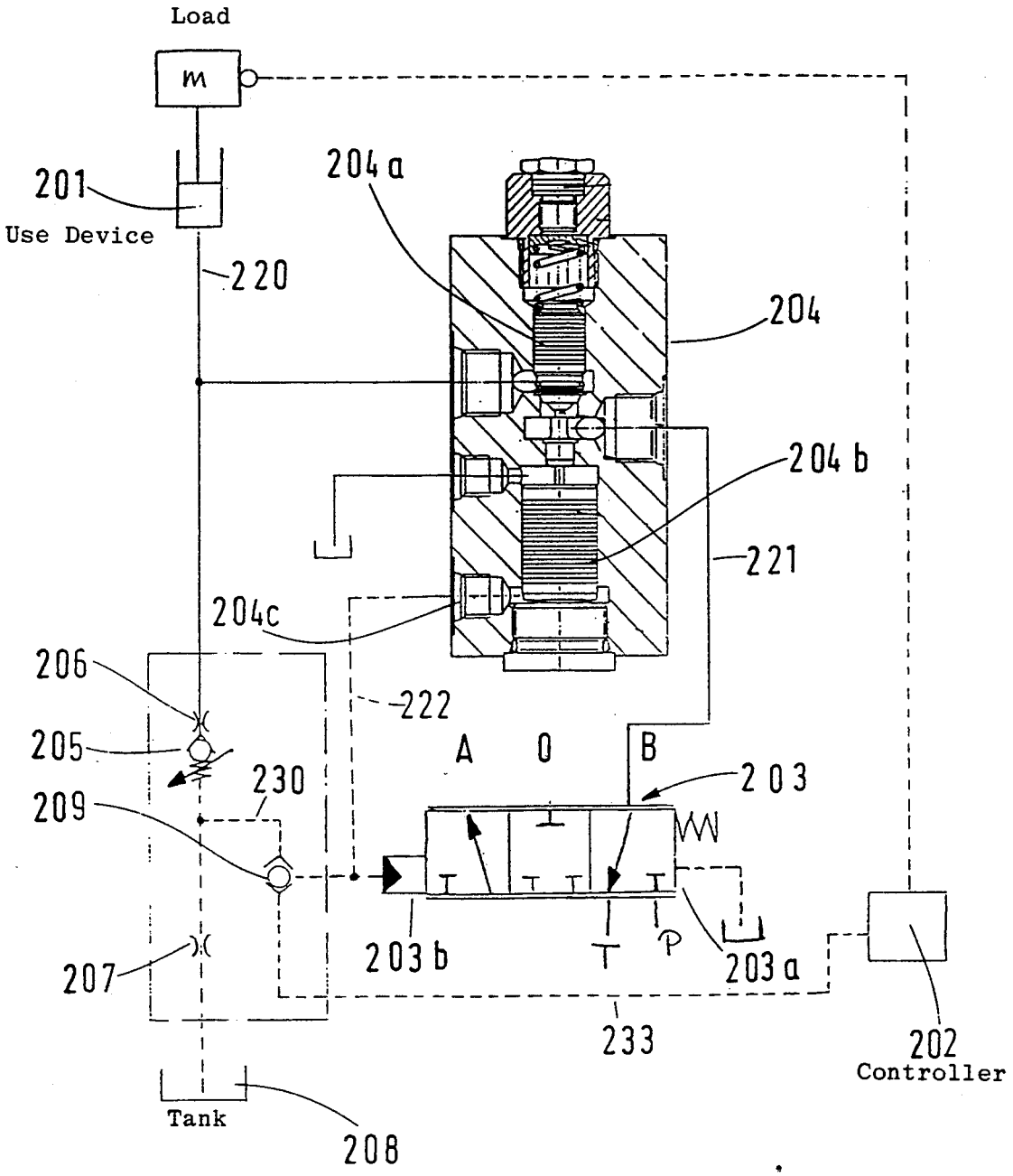
FIG. 3 shows a control circuit as claimed according to a third embodiment.

The third embodiment of a control according to the invention as shown in FIG. 3, like the second embodiment, also provides a hydraulically pilot controlled 3/3 control valve 203 for controlling the use device, which is, however, in contrast to the control valve 103 of the second embodiment, connected to the controller 202 via a connection line 233 only on one control side 203b. In an inoperative state, the slider of the control valve 203 is biased into the switching position B by a spring provided on the other control side 203a which is connected to the tank 208. In this switching position, the work line 221 is directly connected to the tank 208. The remainder of the circuit essentially corresponds to the circuit according to the second embodiment so that a further explanation of the circuit construction does not seem necessary.

In the following the functioning of the circuit, in particular the functioning of the control valve 203 according to the third embodiment, is explained in detail:

If, for example, the control valve 203 is actuated for lifting the use device 201, the slider is displaced against the biasing force of the spring into switching position A (according to FIG. 3 to the left), whereby the work line 221 is connected to the feed pump and hydraulic fluid is supplied to the use device 201 via the blocking device 204 and the work line 220.

In the switching position 0 of the slider, all ports at the control valve 203 are closed.

After the use device 201 e.g. has been extended to its maximum lift position and no pressure is existing in the pilot control circuit together with the control line 222, the slider of the control valve 203 is displaced e.g. into the switching position B by the biasing force of the spring on the control side 203a, thereby, the work line 221 anew being connected to the tank 208. As a result of the pressure decrease in the work line occurring in this connection and the pressure load existing in the work line 220, the main cone 204a of the blocking device 204 is closed, so that the volume of oil in the use device 201 and the work line 220 is restrained between the use device 201 and the blocking device 204.

In accordance with the first and second embodiment, for compensating static and/or quasi-static pressure increases, the power supply being switched off, the hydraulic fluid in the work line 220 is discharged to the tank 208 by way of the pressure control valve 205.

In the case of dynamic pressure increases beyond the predetermined maximum pressure $Pz_{max}$, by an opening of the pressure control valve 205, a pressure signal is supplied into the hydraulic pilot control circuit of the control valve 203 through the shuttle Valve 209 and, via the control line 222, directly applied to the control port 204c of the stop valve 204. The pressure signal, however, only causes a movement of the control piston 204b and an opening of the blocking device 204, while the slider of the control valve 203 is still held in the switching position B by the biasing force of the spring. This means that the pressure signal from the pressure control valve 205 causes an opening of the stop valve 204, however, that it is not sufficient to displace the control valve 203 from its biased switching position B in which the work line 221 is directly connected to the tank 208.

In all three embodiments, however, the pressure control in the use device is performed by the pilot control circuit; that is, supervision, correction and limiting of the compensation processes by the positioning control circuit are within the energy level of the pilot control circuit.

We claim:

1. A circuit for limiting a static or dynamic pressure load in a hydraulically actuated use device which is controlled in a closed control circuit by means of a directional control valve and a mechanically or hydraulically releasable blocking device, wherein a pressure control valve is arranged between said use device, and said pressure relief valve being adapted to discharge a hydraulic fluid from said use device can be connected to one control side of the control valve via a control line, so that the control valve can be set at a switching position connecting the feed line to said use device to a tank when a predetermined hydraulic pressure in said use device is exceeded, characterized in that the output port of said pressure relief valve is connected to a hydraulic control line adapted to hydraulically connect said pressure relief valve to a control side of said control valve whereby said control valve is turned by the discharging pressure of said pressure relief valve in a switching position in which a feed line leading to said use device is connected with said tank, and said blocking device is turned in a released state so that the hydraulic fluid in said use device is discharged to said tank via said blocking device and said control valve.

2. A circuit according to claim 1, characterized in that said directional control valve is controlled by a controller via at least one connection line of a pilot control circuit of said directional.

3. A circuit according to claim 2, characterized in that said connection line of said pilot control circuit of said directional control valve and said control line leading away from said pressure relief valve are directed to a shuttle valve (9, 109, 209) whose output port is connected to the control side (3*b*, 103*b*, 203*b*) of said directional control valve (3, 103, 203).

4. A circuit according to one of the claim 3, characterized in that said directional control valve is a pilot controlled 5/3 proportional valve which, on the one hand, controls the connection between a work line and a feed pump or a tank and, on the other hand, controls the connection between a control port of said blocking device and a control line (P1) leading a control pressure for pilot control of said blocking device.

5. A circuit according to the claim 3, characterized in that the control valve is a pilot controlled 3/3 proportional valve controlling the connection between a work line and a feed pump or said tank.

6. A circuit according to the claim 1, characterized in that said control valve is biased to a neutral position by a spring arranged at each control side, in which neutral position all ports at said control valve are closed.

7. A circuit according to claim 5, characterized in that a control post of said blocking device is directly connected to the control side of said control valve via a control line.

8. A circuit according to claim 5, characterized in that, on one control side, said control valve is biased into a switch position (B) by a spring, in which position said work line is connected to said tank.

9. A circuit according to the claim 1, characterized in that said pressure relief valve

10. A circuit according to claim 1, characterized in that an orifice plate is arranged upstream of said pressure control valve and an orifice plate is arranged downstream of said pressure relief valve, so that the pressure signal is adjusted to the pressure level of said control valve's pilot control circuit.

11. A circuit according to claim 1, characterized in that said blocking device is a hydraulically releasable check valve including an additional oil leakage port.

* * * * *